US005855773A

United States Patent [19]

Lasota

[11] Patent Number: 5,855,773

[45] Date of Patent: Jan. 5, 1999

[54] CENTRIFUGE BOWL HOUSING AND LATCH FOR BLOOD SEPARATION APPARATUS

[75] Inventor: Jacek Lasota, Thornton, Colo.

[73] Assignee: Medtronic Electromedics, Inc., Parker, Colo.

[21] Appl. No.: 788,427

[22] Filed: Jan. 28, 1997

Related U.S. Application Data

[60] Provisional application No. 60/010,924 Jan. 31, 1996.

[51] Int. Cl.[6] ..... B04B 1/00; B65D 43/16

[52] U.S. Cl. ..... 210/146; 210/360.1; 210/380.1; 220/315; 220/326; 422/72; 494/7; 494/43; 494/60

[58] Field of Search ..... 210/146, 360.1, 210/380.1; 220/315, 323, 324, 326, 327, 328; 422/72; 494/7, 43, 60

[56] References Cited

U.S. PATENT DOCUMENTS 3,762,552 10/1973 Landwier ..... 210/146
4,341,342 7/1982 Hara ..... 494/60
5,114,533 5/1992 Guy et al. ..... 494/60
5,242,370 9/1993 Silver et al. ..... 494/60

*Primary Examiner*—David A. Reifsnyder
*Attorney, Agent, or Firm*—Ancel W. Lewis, Jr.

[57] ABSTRACT

The present invention is a centrifuge bowl housing and cover latch suitable for use in a blood separation system. The housing is mounted on shock absorbers to minimize transmission of vibrations from the centrifuge. The housing is configured to retain spilled liquids, efficiently collect the spilled liquids, drain liquids away from the drive means, and drain liquids out of a drain port to a collection container. The housing has a transparent cover that opens to allow loading of centrifuge bowls into the housing. The cover is a shatter resistant material and when closed, seals the top of the housing, retaining blood components and flying pieces of a centrifuge bowl if the bowl breaks. The cover has a latch that prevents the centrifuge from spinning when the cover is open and prevents opening of the cover when the centrifuge is spinning.

11 Claims, 6 Drawing Sheets

CENTRIFUGE BOWL HOUSING AND LATCH FOR BLOOD SEPARATION APPARATUS

This application claims the benefit under 35 U.S.C. §119(e) of the U.S. provisional patent application No. 60/010924 filed Jan. 31, 1996.

1. Technical Field

The present invention relates to blood separation apparatus and more particularly to centrifuge bowl housings and cover latches thereof.

2. Background Art

Surgical operations, including more complex operations where a substantial amount of bleeding may occur, may require transfusions during the course of the surgery to maintain a sufficient blood volume and blood pressure. Whole human blood is composed of several components, including red blood cells, plasma, platelets, leukocytes or white blood cells, and cellular debris. Human blood can be separated into the constituent components so that only the desirable components are injected into a patient. Centrifuges have been developed for rapidly and efficiently separating blood or other biological fluids into constituent components.

Since many blood-borne diseases may exist including hepatitis, cancer and HIV, it is desirable to contain any fluids that could be spattered by a rapidly rotating centrifuge bowl if the bowl should break. It is also desirable to prevent injury to nearby personnel from flying pieces of a centrifuge bowl if a rapidly rotating centrifuge bowl breaks.

Centrifuges for blood separation disclosed in the prior art include a housing and a cover. Typically these centrifuges have a sensor between the housing and cover that sends a signal to the centrifuge controller when the cover is opened so that the controller will shut off power to the centrifuge drive motor. On centrifuges without a latch to hold the cover closed, spattered blood and flying bowl fragments from a broken centrifuge bowl can partially open the centrifuge cover and escape.

Some of the prior art centrifuges include a latch system that holds the cover closed. The cover on each of these centrifuges can be opened before the centrifuge stops spinning, presenting a risk of injury to an operator as well as the hazards of spattered blood and flying bowl fragments as discussed above.

Prior art centrifuges do not provide automatic collection of fluids spilled within the housing, prevention of contamination of the drive means bearings by corrosive spilled blood components, or positive sealing of the housing/cover interface to prevent leakage of fluids.

Centrifuges spin at high speeds. Any imbalance in the centrifuge mechanism or centrifuge bowl creates vibrations. Existing centrifuges use balanced seamless bowls or use elastomeric material for grip the bowl.

DISCLOSURE OF THE INVENTION

The centrifuge bowl housing and latch disclosed are suitable for use in a blood separation apparatus. The centrifuge bowl housing contains a centrifuge bowl which is rotated at high speeds for blood separation purposes. The cover seals the housing when closed, preventing leakage of blood or other fluids, and, in the situation where a centrifuge bowl breaks, preventing possible injury to an operator. The convex shape of the bottom drains fluids away from the centrifuge drive shaft and collects spilled fluids in a peripheral channel. A drain port which may be connected to a waste bag is connected to the peripheral channel for automatic collection of spilled fluid.

The latch prevents the centrifuge running if the cover is open. A latch lock prevents opening the cover if the centrifuge is running.

The centrifuge bowl housing is supported on shock absorbers which minimize transmission of vibration and eliminate the need for expensive balancing of the bowl or complex means for retaining the bowl.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
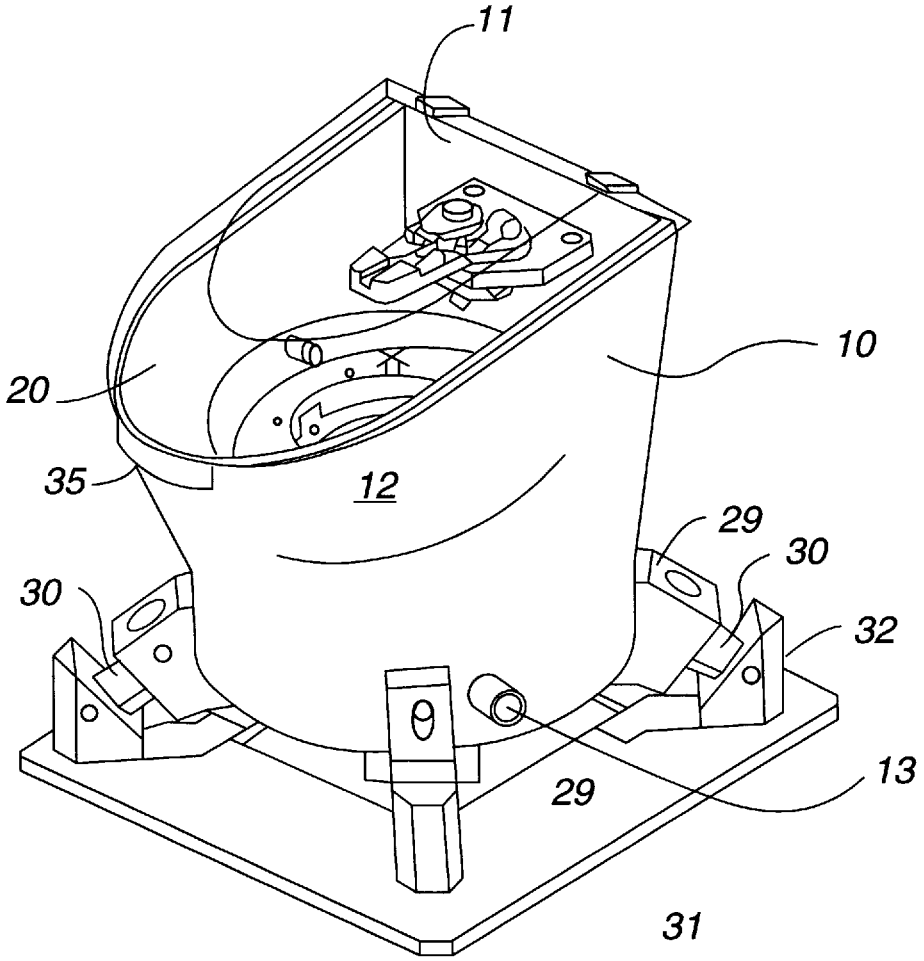
FIG. 1 is a perspective view of a centrifuge bowl housing embodying the present invention.

Referring now to FIG. 1, the centrifuge housing and latch for blood separation apparatus, generally stated, includes a horizontal base 31, a housing 10 supported by base 31, a cover 20 pivotally attached at one end to housing 10, and a latch 35 latching the opposite end of the cover 20 to the housing 10.

Base 31 is in the form of a flat square plate and has a base leg 32 rigidly attached at each corner. A shock absorber 30 rigidly attaches to each base leg 32. A housing leg 29 supporting housing 10 rigidly attaches to each shock absorber 30. Each shock absorber 30 is a short cylinder of elastomeric or rubber material with a threaded metal projection a, each end for attachment to the base leg 32 and the housing leg 29. Shock absorbers 30 minimize the transmission of vibration between housing 10 and base 31.

Figure 2:
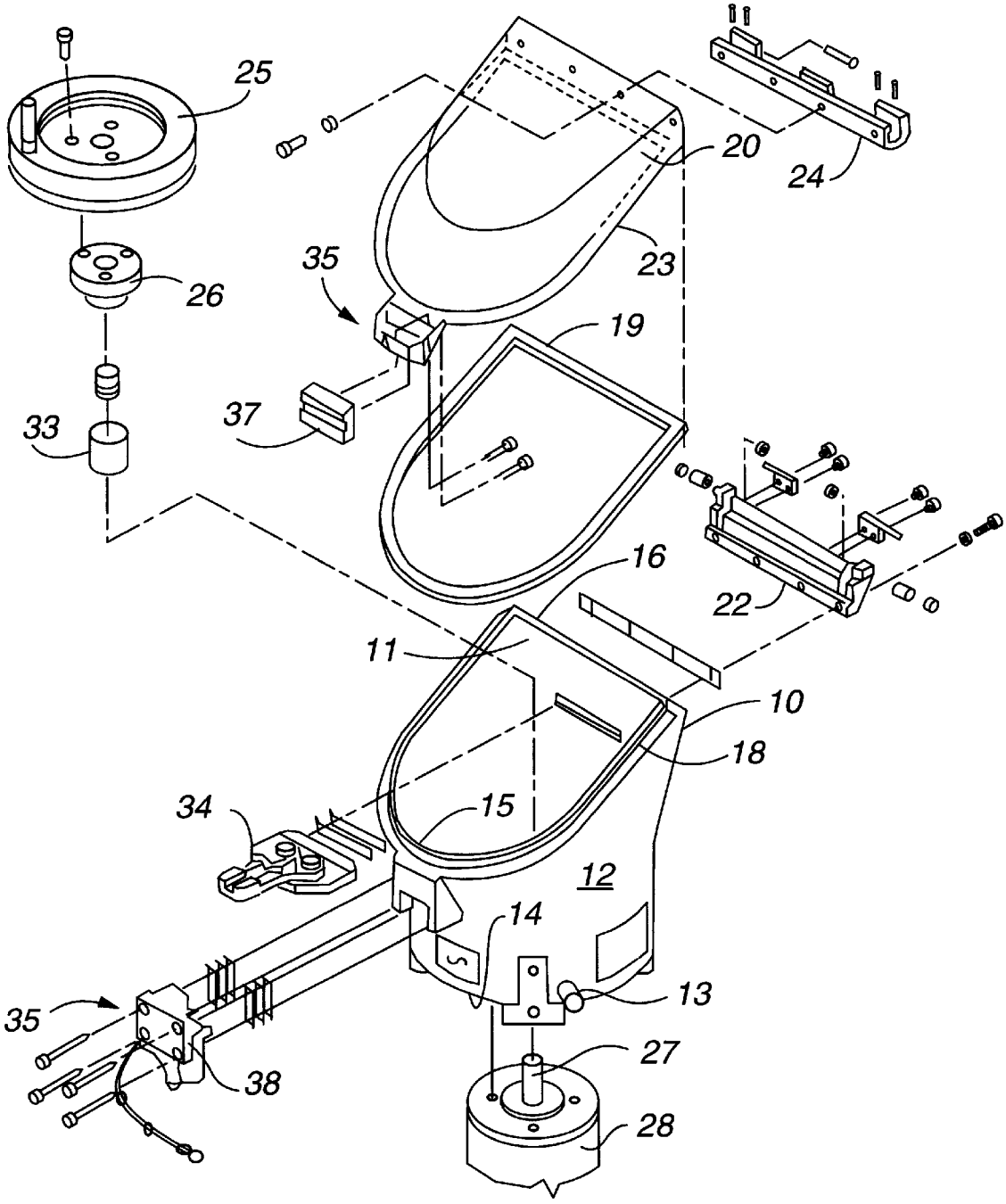
FIG. 2 is an exploded perspective view of a centrifuge bowl housing and latch embodying the present invention.

Referring to FIG. 2, centrifuge bowl housing 10 has a circular bottom wall 14, a cylindrical lower wall portion 9 extending up from bottom wall 14, and a flat back wall 11 and a curved side and front wall 12 extending up from lower wall portion 9. The lower portion of centrifuge bowl housing 10 has a circular cross section while the upper portion flares out. The opening formed by the upper edge 16 of rear wall 11 and the upper edge 15 of side and front wall 12 is a truncated oval with a straight side. Bottom wall 14 has a convex upper side to drain liquid away from the center. A channel is formed between the periphery of bottom wall 14 and lower wall portion 9 to collect spilled liquid. Drain port 13 attached at the bottom of lower wall portion 9 drains liquids from the housing.

Figure 3:
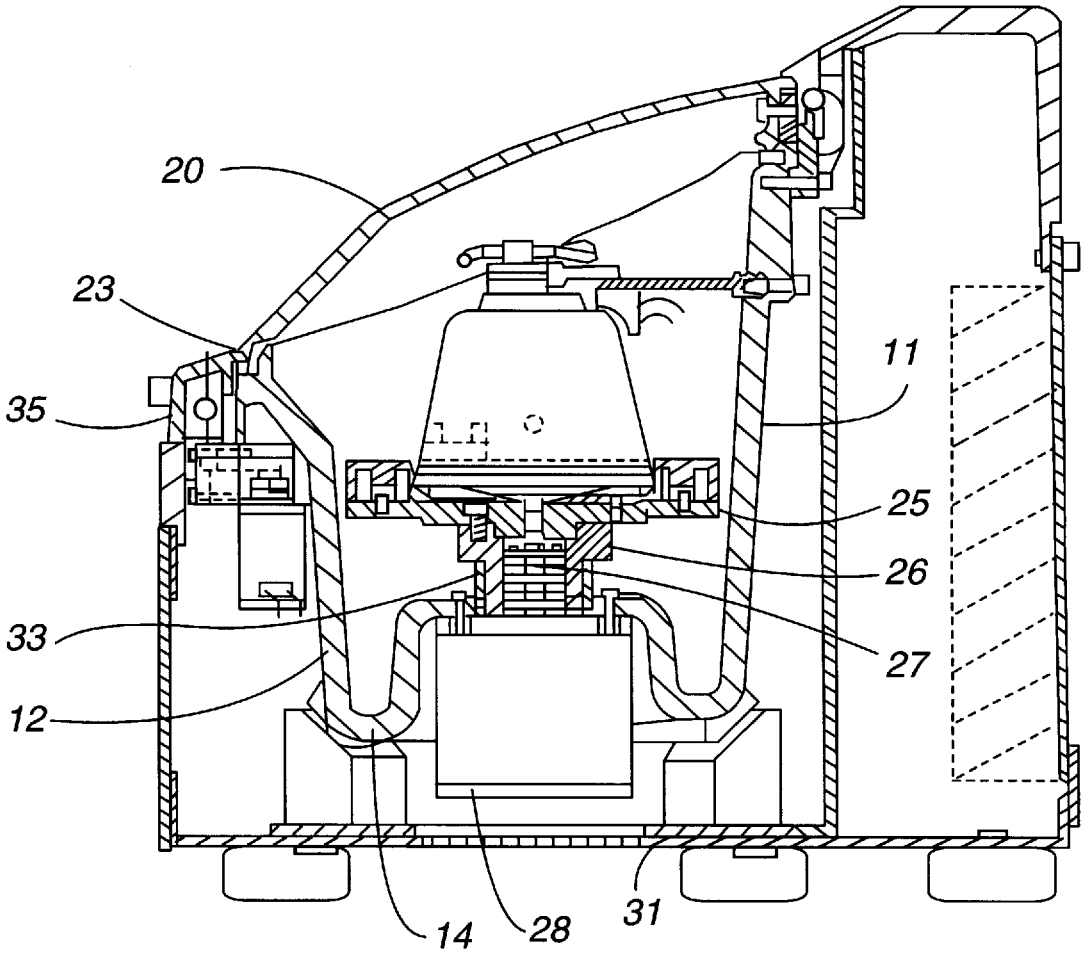
FIG. 3 is a cross sectional view of a centrifuge bowl housing and latch embodying the present invention.

Referring to FIG. 3, a drive motor 28 is rigidly attached to the underside of bottom wall 14. Drive motor 28 has an output shaft 27 which protrudes through bottom wall 14 into the interior of housing 10. A drive flange 26 in the interior of housing 10 is rigidly attached to output shaft 27. A rotary plate 25 is rigidly attached to the upper surface of drive flange 26. A seal 33 attached to bottom wall 14 and closely encircling drive shaft 26 prevents leakage of liquid from housing 10.

Returning now to FIG. 2, the upper edge 15 of side and front wall 12 slopes downwardly and forwardly from upper edge 16 of rear wall 11. The exterior portions of upper edge 15 of side and front wall 12 and upper edge 16 of rear wall are relieved to define shoulder 18. Shoulder 18 supports sealing gasket 19 which is shaped to conform to edges 15, 16 of the housing walls.

The cover 20 is made of a high impact resistant transparent material such as polycarbonate. Cover 20 is convex forming a dome. The lower edge 23 of cover 20 has a V shape, the point of V shaped lower edge 23 is formed to compress the center of the top face of sealing gasket 19 when cover 20 is closed. Cover 20 is pivotally attached to housing 10 at upper edge 16 of rear wall 11 by hinge 21. Hinge 21 has a hinge section 22 rigidly attached to rear wall 11 and hinge section 24 rigidly attached to cover 20, the hinge sections being appropriately pivoted together. When closed and latched, cover 20 seals centrifuge bowl housing 10.

Latch 35 is formed by lower first latch portion 36 and upper second latch portion 37. First latch portion 36 is rigidly attached to the upper portion of side and front wall 12 at the front of housing 10, opposite rear wall 11. Second latch portion 37 is rigidly attached to cover 20 at the front of cover 20 so that when cover 20 is closed second and first latch portions 36, 37 interact to hold cover 20 closed.

Figure 4:
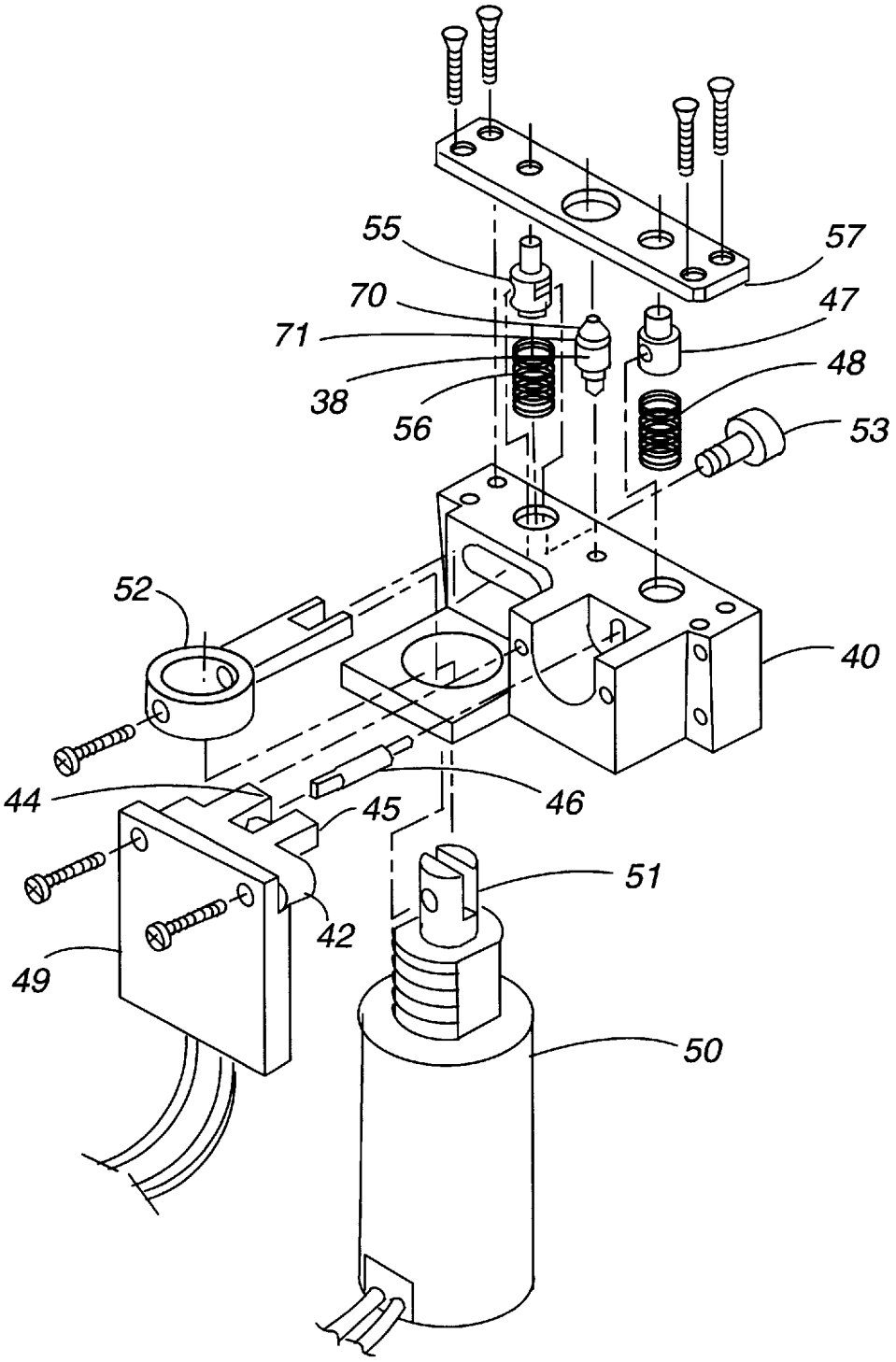
FIG. 4 is an exploded perspective view of a first latch assembly for a centrifuge bowl housing.

Referring to FIG. 4, first latch portion 36 includes first latch block 40, a latch pin 38, a flag pin 47, a lock pin 55 and a first latch cover 57. First latch cover 57 is a flat plate which is fastened to the upper surface of first latch block 40 and is provided to facilitate assembly and retention of flag pin 47 and lock pin 55.

Latch pin 38 is cylindrical with a conical or tapered head 70 on one end, and a threaded section on the other end. An annular groove 71 is relieved in latch pin 38 adjacent to the head. The shoulder formed on the back of the head by the groove is the first latch face 72. A threaded aperture is formed in the upper surface of first latch block 40 to receive the threaded first portion of latch pin 38. A hole is formed in first latch cover 57 allowing latch pin 38 to project through first latch cover 57.

Lock pin 55, when in a first or lock position prevents unlatching of latch 35. Lock pin has an cylindrical first portion and cylindrical second portion of larger diameter than the first portion, forming a shoulder between the portions. A vertical cylindrical lock pin aperture with a closed first end and an open second end, and with a diameter greater than the second portion of the lock pin 55 is relieved in the top surface of the first latch block 40 to receive a coil spring 56 and lock pin 55. A lock pin hole is formed in first latch cover 57 that allows the smaller first portion of lock pin 55 to extend through first latch cover 57 but retains the second portion of lock pin 55. Coil spring 56 is assembled between the closed end of the lock pin aperture in first latch block 40 and the second portion of the lock pin 55, biasing the shoulder of the lock pin 55 against the lower surface of first latch cover 57 and thereby biasing lock pin 55 to the first or lock position. When lock pin 55 is in the lock position, the first portion of lock pin 55 extends beyond first latch cover 57 so that the end of lock pin 55 is planar with the first latch face.

Lock pin arm 52 has a forked first end with two prongs and a band shaped second end. The prongs of the forked first end of lock pin arm 52 fit through an aperture in the rear surface of the first latch block 40 that connects to the lock pin aperture in first latch block 40 and into horizontal slots formed in the second portion of lock pin 57. The band shaped second end of lock pin arm 52 is formed to receive the end a solenoid shaft 51 which is rigidly attached to the second end by a suitable fastener such as a screw. Solenoid shaft 51 is actuated by solenoid 50 which is rigidly attached to the first latch block 40. Actuation of the solenoid 50 pulls shaft 51 down, moving lock pin arm 52 down, pulling lock pin 55 down to a second or unlock position.

Emergency release 53 is cylindrical with an enlarged first end and a threaded second end. The threaded second end of emergency release 53 passes through a vertical slot in the front face of the first latch block 40 that communicates with the lock pin aperture in the first latch block 40 and is screwed into a threaded aperture in the second portion of lock pin 55 perpendicular to the cylindrical axis of lock pin 55. Downward force on the emergency release 53 moves lock pin 55 to the second or unlock position.

Optical sensor 42, flag 46, flag pin 47 and flag pin actuator 64 detect whether the cover 20 is closed. Flag pin 47 has a cylindrical first portion and cylindrical second portion of larger diameter than the first portion, forming a shoulder between the portions. A vertical cylindrical flag pin aperture with a closed first end and an open second end, and with a diameter greater than the second portion of the flag pin 47 is relieved in the top surface of the first latch block 40 to receive a coil spring 48 and flag pin 47. A flag pin hole is formed in first latch cover 57 that allows the smaller first portion of flag pin 47 to extend through first latch cover 57 but retains the second portion of flag pin 47. Coil spring 48 is assembled between the closed end of the flag pin aperture in first latch block 40 and the second portion of the flag pin 47, biasing the shoulder of the flag pin 47 against the first surface of first latch cover 57 and thereby biasing flag pin 47 to an first or nonflag position. The length of the first portion of flag pin 47 is the same as the thickness of first latch cover 57 so that the top surface of flag pin 47 is flush with the top surface of first latch cover 57 when flag pin 47 is in the first or nonflag position.

Flag 46 is generally cylindrical with a first end portion having a rectangular flag cross section and an opposite threaded end portion which passes through a vertical flag slot formed between the flag pin aperture and the rear face of the first latch block 40 and threads into a threaded aperture in flag pin 47 perpendicular to the cylindrical axis of flag pin 47. Depressing flag pin 47 through the flag pin aperture in first latch cover 57 moves flag 46 vertically to a second or flag position.

Optical sensor 42 has a transmitter first pole 44 and a receiver second pole 45, and is mounted with sensor cover 49 in a channel block 43 on the rear face of first latch block 40. Optical sensor 42 is positioned such that the optical path between first pole 44 and second pole 45 is not blocked by flag 46 when flag 46 is in the first or nonflag position and the optical path between first pole 44 and second pole 45 is blocked by flag 46 when flag 46 is in the second or flag position.

Figure 5:
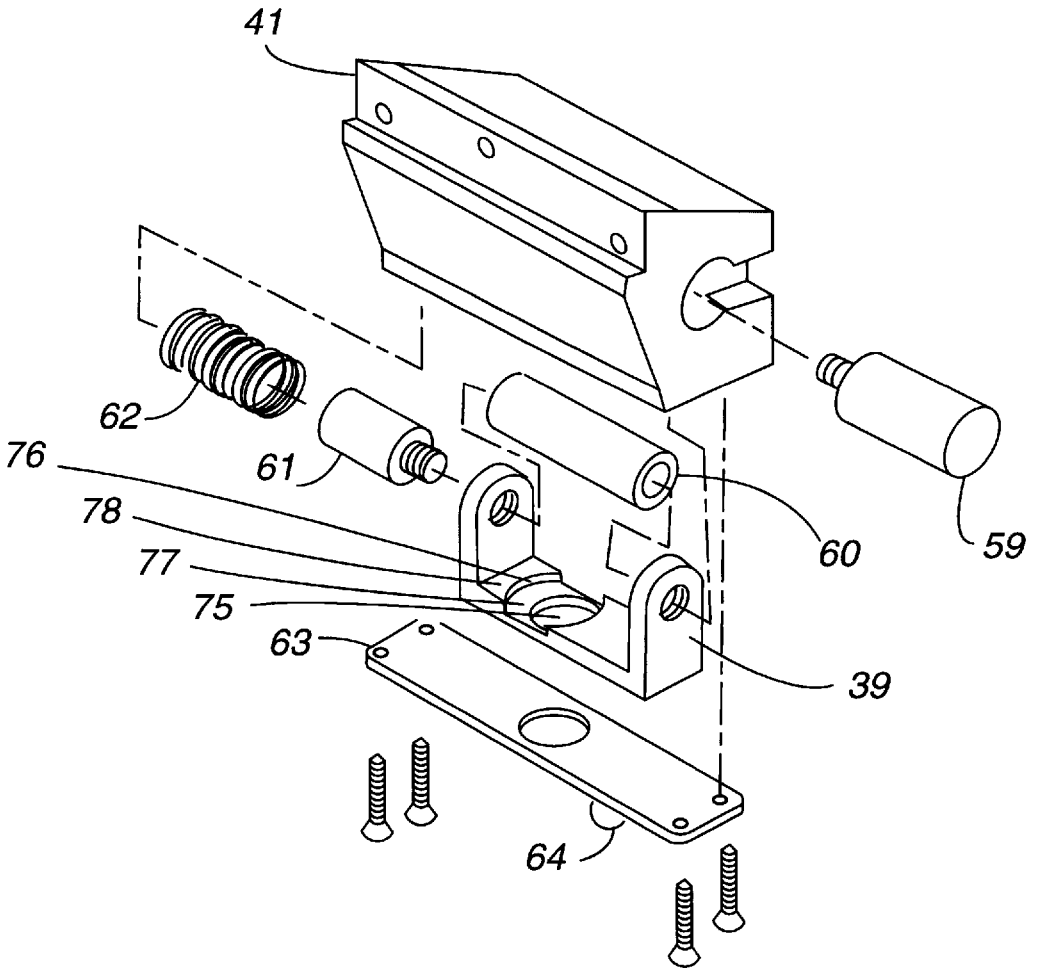
FIG. 5 is an exploded perspective view of a second latch assembly for a centrifuge bowl housing.

Second latch portion 37 includes a second latch block 41 having a longer top, bottom, front and back surface, and shorter right and left surface, a latch plate 39, a release button 59, a tube 60, a spring limit pin 61, a coil spring 62, and a second latch cover 63. FIG. 5 shows an exploded, perspective view of second latch 37 with the top, back and left surfaces of second latch block 41 toward the viewer. Latch plate 39 is U shaped with a center portion and a first and second upright portion, each upright portion having a threaded hole formed therein. A circular latch pin hole 75 of diameter slightly larger than the head of latch pin 38 is formed through the center portion of latch plate 39. A larger diameter circular depression 76 is formed through the upper half of the center portion of latch plate 39, concentric to the latch pin hole 75. The shoulder 78 formed by latch pin hole 75 provides a second latch face 77.

A horizontal cylindrical cavity is formed in the left surface of second latch block 41 to receive the spring limit pin 61, coil spring 62, tube 60, and release button 59. A latch plate channel which communicates with the horizontal cylindrical cavity is formed in the bottom surface of second latch block 41 to receive the latch plate 39, the latch plate channel being wider than the distance between the upright portions of latch plate 39 allowing latch plate 39 side to side movement in the latch plate channel.

Spring limit pin 61 has a larger cylindrical portion sized to fit within the inside diameter of coil spring 62, and a threaded portion which threads into the threaded hole in the first upright portion of latch plate 39 toward the second upright portion of latch plate 39, the threaded portion being longer than the thickness of the first upright portion of latch plate 39 and extending into the space between the first and second upright portions of latch plate 39. Release button 59 has a larger cylindrical portion sized to fit within the horizontal cylindrical cavity formed in second latch block 41, and a threaded portion which threads into the threaded hole in the second upright portion of latch plate 39 toward the first upright portion of latch plate 39, the threaded portion being longer than the thickness of the second upright portion of latch plate 39 and extending into the space between the first and second upright portions of latch plate 39. Tube 60 is the length of the distance between the first and second upright portions of latch 39 and has an inner diameter larger than the threaded portions of spring limit pin 61 and release button 59, so that tube 60 is assembled between the first and second upright portions of latch 39 and held in place by the parts of the threaded portions of spring limit pin 61 and release button 59 that extend into the space between the first and second upright portions of latch plate 39. Coil spring 62 fits around spring limit pin 61 and is assembled into the closed right end of the horizontal cylindrical cavity in second latch block 41, biasing latch plate 39 against the left side of the latch plate channel in second latch block 41. The cylindrical portion of spring limit pin 61 is shorter than the distance from the first upright portion of latch plate 39 to the closed right end of the horizontal cylindrical cavity in second latch block 41, allowing latch plate 39 to move to the right a predetermined distance when the end of the cylindrical portion of release button 59, which projects at least the predetermined distance beyond the left surface of second latch block 41, is pressed.

Second latch cover 63 is rigidly attached to the bottom surface of second latch block 41 and has a latch pin hole of diameter slightly larger than the head of latch pin 38 which aligns with the latch pin hole in latch plate 39 when latch plate 39 is moved to right as far as spring limit pin 61 allows, a lock pin hole of diameter slightly larger than the second portion of lock pin 55, the left edge of the lock pin hole aligning with the right side of the first upright of latch plate 39 when latch plate 39 is biased against the left side of the latch plate channel in the bottom surface of second latch block 41, and a flag pin actuator 64 which is a cylindrical projection of diameter slightly smaller than the flag pin aperture in first latch block 40 that aligns with the flag pin aperture in first latch block 40 when latch 35 is closed.

Figure 6:
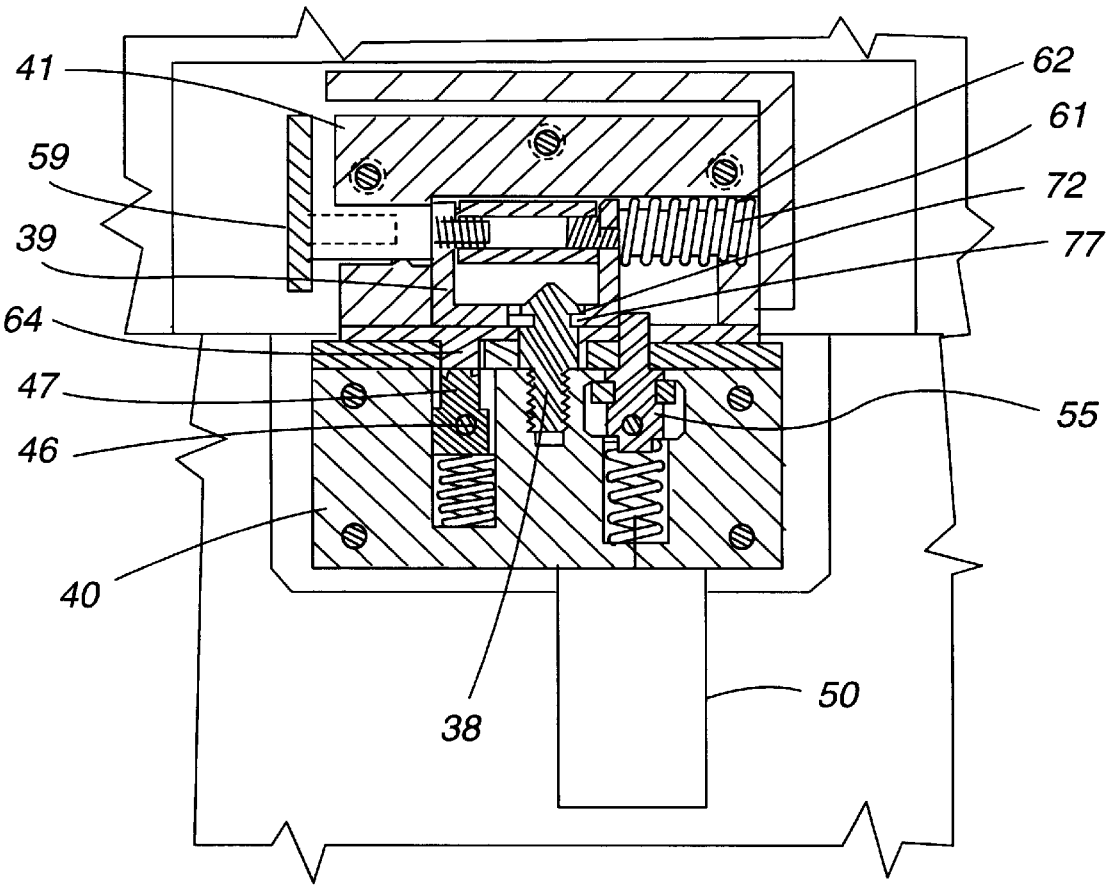
FIG. 6 is a cross sectional view of a latch assembly for a centrifuge bowl housing.

FIG. 6 shows the operation of latch 35. As cover 20 is closed the conical head 70 of latch pin 38 contacts the right edge of the latch pin hole 75 in latch plate 39. Downward pressure on second latch 37 forces the right edge of the latch pin hole 77 in latch plate 39 along the surface of the head 70 of latch pin 38, compressing coil spring 62 and moving latch plate 39 to the right until the right edge of the latch pin hole 75 in latch plate 39 is even with the periphery of latch pin 38. The right edge of latch plate 39 has moved to the right over the edge of lock pin 55 so that lock pin 55 is pushed down during latching. Second latch 37 moves down until the shoulder 78 on latch plate 39 in aligned with the annular groove 71 in latch pin 38 and the shoulder 78 on latch plate 39 is forced into the annular groove on latch pin 38 by pressure from coil spring 62, the second latch face 77 thereby overlapping first latch face 72 to retain latch 35 in a latched position. When the shoulder 78 in latch plate 39 moves into the annular groove 71 in latch pin 38, the right edge of latch plate 39 clears the top of lock pin 55, allowing lock pin 55 to extend to the lock position with the left side of lock pin 55 against the right side of latch plate 39, preventing movement of latch plate 39. During closure flag pin actuator 64 depresses flag pin 47, moving flag 46 to the flag position.

Solenoid 50 is coupled to the drive motor 28 so that solenoid 50 actuates when drive motor 28 is stopped. Retraction of lock pin 55 to the unlock position by actuation of solenoid 50 allows latch plate 39 to move to the unlatch position. Optical sensor 42 is coupled to drive motor 28 so that drive motor will only run when flag 46 is in the flag position.

Although the present invention has been described with a certain degree of particularity, it is understood that the present disclosure has been made by way of example and that changes in details of structure may be made without departing from the spirit thereof.

What is claimed is:

1. A centrifuge bowl housing and latch for a blood separation apparatus comprising:

a housing for a centrifuge having a top opening, a cover pivotally connected to said housing by a hinge, said cover covering and sealing said top opening when in a closed position, a latch connected between said cover and said housing, said latch having biasing means for biasing said latch toward a latched position and manually actuable release means for moving said latch to an unlatched position, said latch holding said cover in said closed position when said latch is in said latched position and allowing said cover to pivot to an open position only when said release means is manually actuated, and a lock means coupled to said latch, said lock means locking said latch in said latched position and preventing actuation of said release means when said centrifuge is spinning and allowing manual actuation of said release means when said centrifuge is stopped.

2. A centrifuge bowl housing and latch as set forth in claim 1 further comprising:

a base having a plurality of shock absorbers, said housing having a plurality of legs, equal in number to said shock absorbers, circumferentially spaced at equal intervals and supported on said shock absorbers, said shock absorbers preventing vibrations transmitting from said housing to said base.

3. A centrifuge bowl housing and latch as set forth in claim 2 wherein said base is a square with one of said shock absorbers being mounted at each corner so that said legs are circumferentially spaced at equal ninety degree intervals around said housing.

4. A centrifuge bowl housing and latch as set forth in claim 1 wherein said housing has a bottom wall with a concave bottom side, a convex top side and a circular outer edge, a cylindrical lower wall portion extending up from said bottom wall, forming an annular fluid receiving channel for collection of spilled liquid, a drain port opening into said channel for draining of said spilled liquid, an upper wall portion extending up from said lower wall portion, said upper wall portion including a flat back portion with an horizontal upper edge and a curved front and side portion with an upper edge sloping forwardly and downwardly from said upper edge of said back portion, said bottom wall, lower wall portion and upper wall portion forming an interior chamber for retaining spilled liquid and draining said liquid through said drain port.

5. A centrifuge bowl housing and latch as set forth in claim 4 wherein said upper edges of said back portion and said front and side portion of said upper portion of said housing have an exterior shoulder with a gasket shaped to conform to and supported by said shoulder, and said cover is a convex dome of transparent, shatter resistant material with a lower outside edge conforming to said gasket, said lower outside edge of said cover having a downward convex V cross section which compresses an intermediate portion of a top side of said gasket when said cover is in said closed position thereby sealing said top opening in said housing.

6. A centrifuge bowl housing and latch as set forth in claim 5 further comprising:

a drive means including a drive motor attached to said bottom side of said bottom wall, a drive shaft attached to said drive motor extending through a center of said bottom wall of said housing up into said housing, a drive flange rigidly attached to said drive shaft inside said housing, a rotary plate rigidly attached to a portion of said drive flange, said bottom wall of said housing has a seal attached thereto, surrounding said drive flange, and extending into said housing, said seal preventing leakage of liquid between said seal and said drive flange, said convex top side of said bottom wall of said housing draining liquid away from said seal.

7. A centrifuge bowl housing and latch as set forth in claim 1 wherein said latch has a first latch portion mounted on said housing and a second latch portion mounted on said cover, said first and second latch portions having first and second latch faces respectively, said latch faces overlapping and engaging one another in a latched position when said cover is in said closed position, said first latch portion including a first latch block and a latch pin on said first latch block, said latch pin having a head on one end with a conical end surface and an annular groove axially inward of said head forming a radially extending said first latch face along the back of said head, said second latch portion including a second latch block, a latch plate slidably mounted in said second latch block and biased to a latch position by a first spring, said latch plate having an aperture forming a shoulder to provide said second latch face, and a release button mounted to said latch plate opposite said first spring and movable with said latch plate to a release position when said release button is pressed, said latch being in said latched position when said cover is closed and said latch plate is in said latch position with said shoulder in said annular groove.

8. A centrifuge bowl housing and latch as set forth in claim 7 wherein said lock means is a lock pin slidably mounted in an aperture in said first latch block, biased by a second spring to a lock position, and attached to a solenoid which moves said lock pin to an unlock position when said solenoid is actuated, said lock pin extending into said second latch block and preventing movement of said latch plate to said release position when said latch is in said latched position and said lock pin is in said lock position, said lock pin, when in said unlock position, allowing said latch plate to move to said release position.

9. A centrifuge bowl housing and latch as set forth in claim 1 further comprising:

a closure sensor coupled to said housing for detecting whether said cover is closed, said closure sensor preventing said centrifuge from spinning when said cover is open, and a closure sensor actuator coupled to said cover that actuates said closure sensor when said cover is closed.

10. A centrifuge bowl housing and latch as set forth in claim 9 wherein said closure sensor includes a flag pin slidably mounted in a first block mounted on said housing and biased to a nonflag position by a spring, a flag mounted to said flag pin, an optical sensor mounted on said first block with a source pole and a receiver pole, and said sensor actuator is a projection on a second block mounted on said cover which pushes said flag pin to a flag position when said cover is closed, moving said flag between said source pole and said receiver pole, actuating said optical sensor.

11. A centrifuge bowl housing and cover latch comprising:

a base having shock absorbers;

a housing for a centrifuge having a bottom wall with a convex upper side and a circular outer edge, a generally cylindrical vertical wall portion extending up from said bottom wall to form an interior chamber with a top opening and an annular fluid receiving channel adjacent said bottom wall, and a drain port coupled to said channel for draining liquid from said housing, said housing having legs supported on said shock absorbers, said shock absorbers dampening vibrations transmitted by said housing to said base, a cover pivotally connected to an upper edge of said wail portion by a hinge, said cover covering and sealing said top opening when in a closed position, a centrifuge drive means including a drive motor attached to a lower side of said bottom wall, a drive shaft attached to said drive motor and extending through said bottom wall, a rotary plate attached to said drive shaft, and a seal attached to said upper side of said bottom wall, said upper side and said seal draining spilled liquid toward said outer edge and preventing leakage of spilled liquid between said drive shaft and said bottom wall, a latch connected between said housing and said cover, said latch including a first latch portion having a first latch face and mounted on said housing and a second latch portion having a second latch face and mounted on said cover, said latch faces overlapping and engaging one another in a latched position when said cover is in said closed position and retaining said cover in said closed position, said first latch portion including a first latch block and a latch pin on said first latch block, said latch pin having a head on one end with a conical end surface and an annular groove axially inward of said head forming a radially extending said first latch face along the back of said head, said second latch portion including a second latch block, a latch plate slidably mounted in said second latch block and biased to a latch position by a first spring, said latch plate having an aperture defined by a shoulder providing said second latch face, and a release button mounted to said latch plate opposite said first spring and movable with said latch plate to a release position when said release button is pressed, a lock pin for locking said latch when said centrifuge is spinning slidably mounted in an aperture in said first latch block, biased by a second spring to a lock position, and attached to a solenoid which moves said lock pin to an unlock position when said solenoid is actuated, said lock pin extending into said second latch block and preventing movement of said latch plate to said release position when said latch is in said latched position and said lock pin is in said lock position, said lock pin, when in said unlock position, allowing said latch plate to move to said release position, a closure sensor for detecting when said cover is closed and preventing said centrifuge from running when said cover is open including a flag pin slidably mounted in said first latch block and biased to a nonflag position by a third spring, a flag mounted to said flag pin, an optical sensor with a source pole and a receiver pole, and a closure sensor actuator which is a projection on said second latch block which pushes said flag pin to a flag position when said cover is closed, moving said flag between said source pole and said receiver pole, actuating said optical sensor.

* * * * *

UNITED STATES PATENT AND TRADEMARK OFFICE

CERTIFICATE OF CORRECTION

PATENT NO. : 5,855,773
APPLICATION NO. : 08/788427
DATED : January 5, 1999
INVENTOR(S) : Jacek Lasota It is certified that error appears in the above-identified patent and that said Letters Patent is hereby corrected as shown below:

Column 8, line 50, Claim 11, that portion of the claim reading "of said wail" should read --of said wall--.

Signed and Sealed this

Thirty-first Day of July, 2007

JON W. DUDAS
*Director of the United States Patent and Trademark Office*